US006227400B1

(12) United States Patent
Paladino

(10) Patent No.: US 6,227,400 B1
(45) Date of Patent: May 8, 2001

(54) ASHTRAY ASSEMBLY ADAPTED TO BE FIXEDLY MOUNTED TO A WALL OF A BUILDING

(76) Inventor: Mark Paladino, 1460 Oak Hollow Dr., Milford, MI (US) 48380

( * ) Notice: Subject to any disclaimer, the term of this patent is extended or adjusted under 35 U.S.C. 154(b) by 0 days.

(21) Appl. No.: 09/426,366

(22) Filed: Oct. 25, 1999

(51) Int. Cl.[7] ..... B65D 25/22; A24F 21/00

(52) U.S. Cl. ..... 220/478; 220/481; 220/576; 248/225.11

(58) Field of Search ..... 220/576, 478, 220/481; 248/480, 225.11

(56) References Cited

U.S. PATENT DOCUMENTS

| | | | | |
|---|---|---|---|---|
| 1,618,985 | * | 3/1927 | Kelley et al. | 248/480 |
| 2,608,843 | * | 9/1952 | Kennedy | 141/340 |
| 2,661,747 | | 12/1953 | Manion . | |
| 3,052,346 | | 9/1962 | Maron . | |
| 3,472,239 | | 10/1969 | Gielow et al. . | |
| 3,750,824 | | 8/1973 | Walton . | |
| 4,964,425 | | 10/1990 | Chang . | |
| 5,067,626 | * | 11/1991 | Leumi | 220/475 |
| 5,205,299 | | 4/1993 | Chen . | |
| 5,209,446 | * | 5/1993 | Kawai | 248/183.2 |
| 5,947,322 | * | 9/1999 | Ho | 220/477 |

* cited by examiner

*Primary Examiner*—Allan N. Shoap
*Assistant Examiner*—Joe Merek
(74) *Attorney, Agent, or Firm*—Brooks & Kushman P.C.

(57) ABSTRACT

An ashtray assembly ashtray assembly adapted to be fixedly mounted to a wall of a building having a tube-like ashtray with a projection and an alignment fin, a locking nut, and a mounting bracket. The mounting bracket has an elongated vertical slot through it sized to receive the ashtray projection and a coaxial elongated slot on its back surface sized to receive the locking nut. An alignment slot is located on the top surface of the mounting bracket. The projection is inserted through the first elongated vertical slot from the front surface of the mounting bracket and the locking nut is positioned over the projection from the rear surface of the mounting bracket and into the second elongated vertical slot. The assembly is then mounted to a wall or structure. In use, the alignment fin is in the alignment slot to prevent rotation of the assembly. To empty the ashtray, the ashtray is lifting vertically along the elongated slots so that the alignment fin is no longer in the alignment slot and then the ashtray is rotated 180 degrees about the projection to empty its contents. The ashtray is then rotated back to its original position and lowered along the elongated slots until the alignment fin is in the alignment slot.

7 Claims, 2 Drawing Sheets

ASHTRAY ASSEMBLY ADAPTED TO BE FIXEDLY MOUNTED TO A WALL OF A BUILDING

TECHNICAL FIELD

This invention relates to an ashtray having a wall mount and an ashtray rotatable relative to the wall mount for emptying out the ashtray.

BACKGROUND ART

Various ashtray and receptacle designs exist for the temporary storage of ashes and cigarette butts outside of buildings. The better designs are windproof so that burning cigarettes and ashes do not get blown about causing potential fire hazards and eyesores. For example, U.S. Pat. No. 3,750,824 issued Aug. 7, 1973 to Walton discloses a ashtray comprising a receptacle with an opening on its top surface and having a roller with a plurality of arms located in that opening. Cigarette butts or ashes are put in the roller and emptied into the receptacle when the roller is turned. Four obvious drawbacks to this design are the number and complexity of the parts that make up the ashtray, problems associated with emptying out the receptacle, the fact that a user must manually rotate the roller, and easy theft of the ashtray itself.

DISCLOSURE OF INVENTION

The present invention provides an ashtray assembly wherein the burning ashes or cigarettes are contained in a receptacle to prevent them from being blown about in a potentially dangerous manner. The ashtray assembly comprises a tube-like ashtray having an open end and a closed end and a projection extended therefrom. The assembly also includes a locking nut sized to receive the projection. A mounting bracket having top, front, and rear surfaces is also provided. A first vertical elongated slot through the mounting bracket is sized to receive the projection and part of the locking nut. A second vertical elongated slot, coaxial with the first elongated slot, is formed on the back surface of the mounting bracket sized to receive the locking nut. The projection is inserted through the first elongated slot from the front surface and the locking nut is then positioned over the projection and into the second elongated slot. The locking nut is then pressed over the projection thereby locking the ashtray to the mounting bracket. The elongated slots allow the ashtray to be moved by sliding vertically and rotated about the projection. This, in operation, makes the projection and locking nut as a journal and the mounting bracket slots as a bearing.

An alignment fin may be provided on the ashtray tube to rest in an alignment slot or indent on the top surface of the mounting bracket that prevents rotation and further vertically downward movement. Thus, the fin and top surface indent cooperate to form a latch holding the tube-like ashtray upright.

The ashtray is emptied by vertically lifting the ashtray so that the ashtray is unlatched when the alignment fin is no longer in the alignment slot or indent and then rotating the ashtray 180 degrees to dump the collected ashes and cigarette butts. The ashtray is then rotated back 180 degrees and lowered until the alignment fin is in the alignment slot or indent thereby preventing further rotation and downward movement and affixing the ashtray for further collections.

Accordingly it is an object of this invention to provide an improved ashtray assembly that can be fixedly attached to a building to deter theft of the ashtray unit.

Another object of the invention is to provide an ashtray assembly for progressively collecting smoking materials and periodically dumping same. The ashtray includes a collector tube having an open end for receiving smoking materials to be collected, a substantially closed end for retaining the smoking materials collected, a journal portion for pivotally supporting the tube, and a first latch portion. It also includes mounting structure adapted to be fixed relative to a supporting wall and has a second latch portion and an elongated bearing portion configured to pivotally and slidably receive the journal portion. The journal portion of the collection tube is pivotable and slidable with respect to the elongated bearing portion to engage and disengage the first and second latch portions, whereby to respectively position the collector tube in one manner for collecting smoking materials and to position the collector tube in another manner for dumping the smoking materials collected.

Another object of this invention is to provide a slit and locking nub on the alignment fin and a locking notch on the mounting bracket such that the locking nub fits in the locking notch to prevent vertical movement of the ashtray. Ashtray 10 must be rotated such that the locking nub is no longer in the locking notch before it can be removed.

The present invention will become more fully understood from the detailed description below and the accompanying drawings.

BEST MODE FOR CARRYING OUT THE INVENTION

Figure 1:
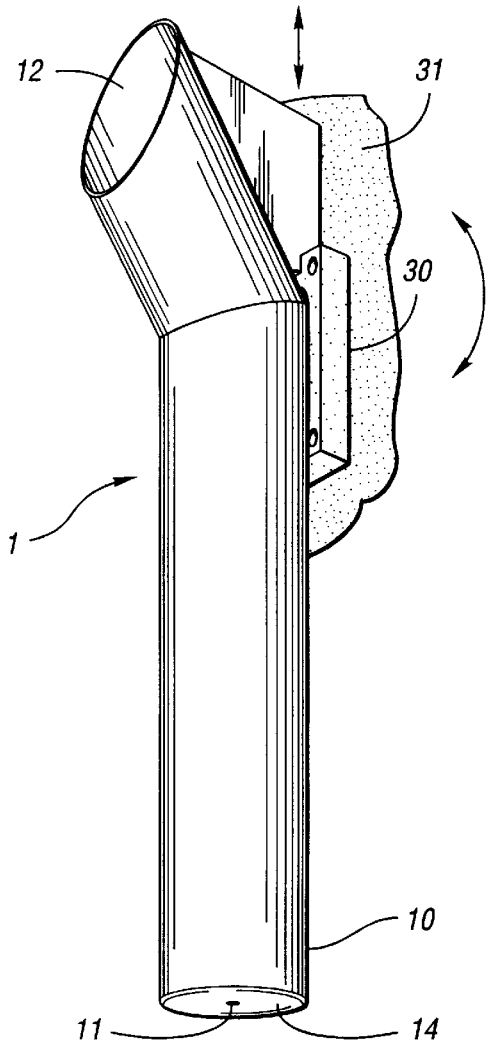
FIG. 1 is a perspective front view of the ashtray assembly of the present invention affixed to a supporting wall.
Figure 2:
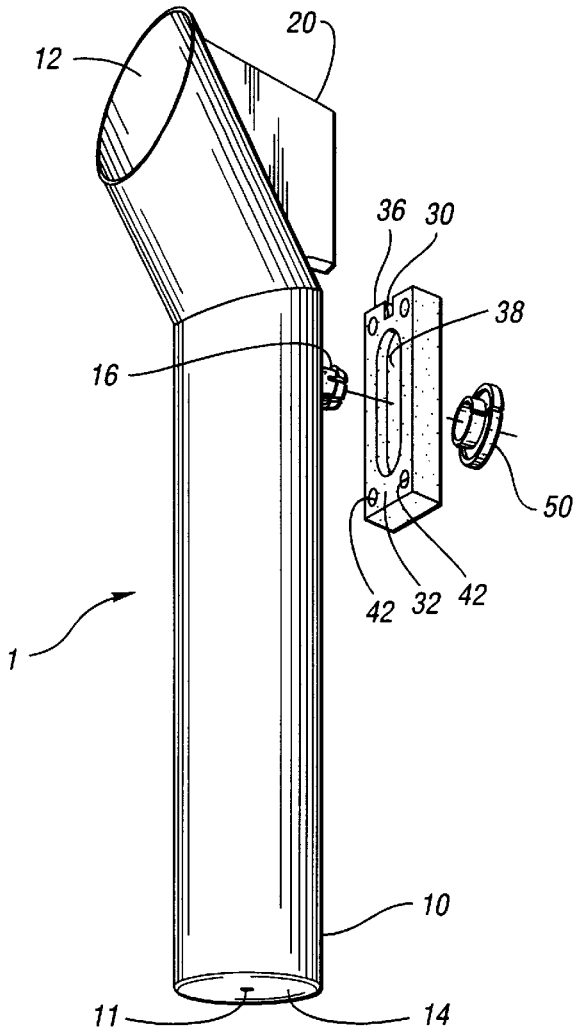
FIG. 2 is an exploded perspective front view of the ashtray assembly of the present invention showing a front view of a mounting bracket.

FIG. 1 depicts a perspective front view of the ashtray assembly 1 of the present invention. FIG. 2 depicts an exploded front view of the ashtray assembly. Ashtray or collector tube 10 is a tube-like structure having an open end 12 for receiving ashes, cigarette butts, or other trash and a closed end 14. Closed end 14 may contain a opening 11 for inserting a rod to assist cleaning out ashtray 10 and for allowing collected fluid such as rain to drain out of ashtray 10. Preferably, ashtray 10 is manufactured out of a fire resistant moldable polymer, although it may also be manufactured out of other fire-resistant materials such as glass, stainless steel or other metals. Projection or journal 16, extending from the back of ashtray 10, is preferably molded or formed as an integral part of ashtray 10. As shown, projection 16 may also be a separate component attached to ashtray 10 using known welding, bonding, insert molding, or other attachment methods.

Figure 3:
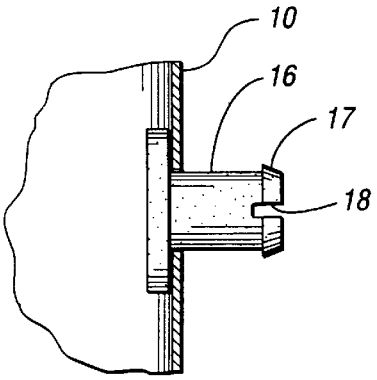
FIG. 3 is a fragmentary sectional view of the ashtray with a projection.

As shown in FIG. 3, projection 16 may comprise an angled lip or chamfer 17 and a plurality of slots or slits 18 to ease its insertion into locking nut 50 as described below. However, any projection and locking nut configuration will suffice as long as the locking nut prevents the projection and thus the ashtray from disengaging from mounting bracket 30.

Figure 6:
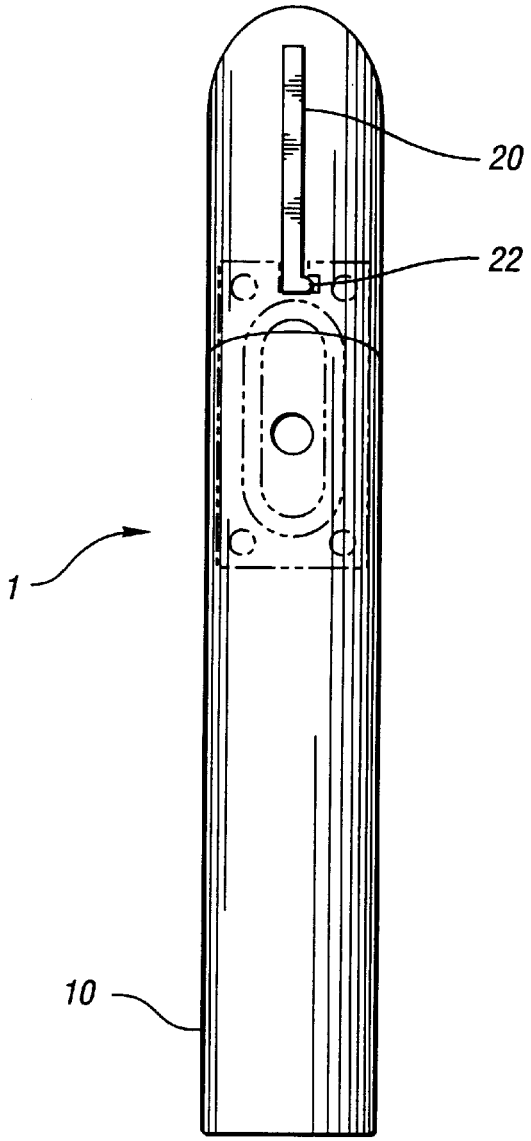
FIG. 6 is a rear view of the ashtray fin showing the locking nub.
Figure 7:
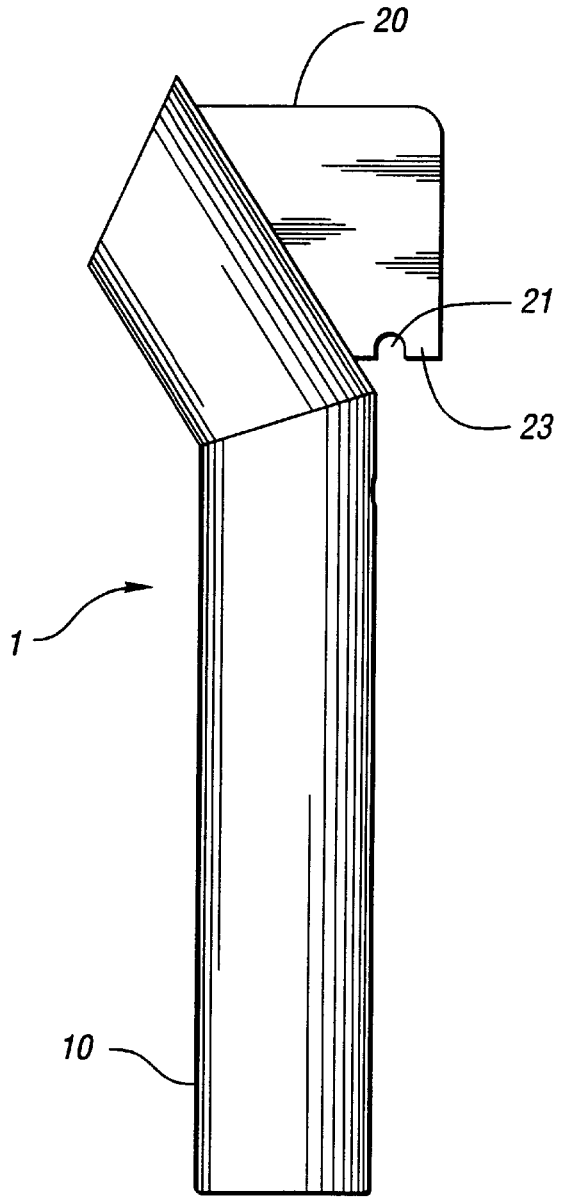
FIG. 7 is a side view of the ashtray showing the notched fin.

Ashtray 10 also comprises alignment fin or first latch portion 20 to prevent unwanted rotation and downward movement of ashtray 10 when fully assembled. Alignment fin 20 is also preferably molded as an integral part of ashtray 10 although it too may be a separate component attached to ashtray 10 using known welding, bonding, insert molding, or other attachment means. Alignment fin 20 may also comprise a slit 21 so that end piece 23 is flexible relative to the rest of fin 20 as shown in FIG. 6. Further, end piece 23 may comprise locking nub 22 as shown in FIG. 6. Slit 21 allows end piece 23 to flex easier.

Figure 5:
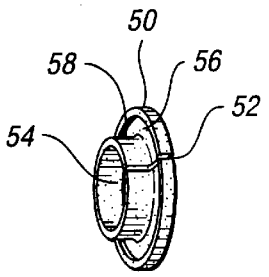
FIG. 5 is a perspective front view of the locking nut for the projection of the ashtray.

Locking nut 50, shown in detail in FIG. 5, comprises a body or head 56, an extension 58, through bore 54, and slot or slit 52. Preferably, locking nut 50 is manufactured out of a resilient, flexible polymer. Bore 54 is sized to receive projection 16 and allow it to freely rotate therein but small enough to prevent angled lips 17 from pulling through. Slot or slit 52 allows locking nut 50 to spread open and fit over angled lip 17 and then return to its proper size. The locking nut can only be removed by spreading it open enough to pull angled lips 17 through bore 54.

Figure 4:
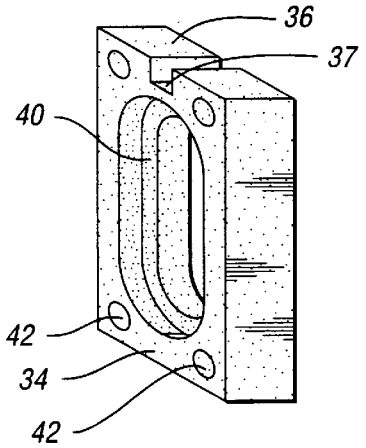
FIG. 4 is a perspective rear view of the mounting bracket.

Mounting bracket 30 is shown in a front perspective view in FIGS. 1 and 2 and in a rear perspective view in FIG. 4. The mounting bracket fixedly attaches to a wall 31 of a building or other supporting structure and may be manufactured out of essentially any material able to sufficiently withstand the environmental and mechanical stresses to which it is subjected. Preferably, mounting bracket 30 is molded out a tough resilient polymer. Mounting bracket 30 has a front surface 32, a rear surface 34, and a top surface 36. In the preferred embodiment, mounting bracket 30 has a first elongated vertical slot or bearing 38 through mounting bracket 30 sized to allow projection 16 and nut extension 58 to freely slide and rotate therein. From rear surface 34, mounting bracket 30 has a second elongated vertical slot or bearing 40 coaxial with the first elongated slot wide enough to allow locking nut body or head 56 to freely slide and rotate therein and deep enough to at least allow locking nut body or head 56 to set flush. Top surface 36 has an alignment slot or second latch portion 37 sized to receive alignment fin 20. Alignment slot 37 may have locking notch 41 undercut into its side sized to receive locking nub 22 on alignment fin 20. Locking nub 22 prevent vertical movement of ashtray 10 when it is positioned in notch 41. The size or depth of first or front elongated vertical slot 38 relative to nut extension 58 and the size of second or rear elongated vertical slot 40 relative to nut body 56 allow for easy sliding movement of ashtray 10 in the vertical direction and rotation without excessive play in the horizontal direction. Mounting bracket 30 is at least as thick as projection 16 is long to prevent any rubbing of projections 16 against the wall 31.

The specific locking nut, projection, and mounting bracket configuration identified in the preferred embodiment is not essential to this invention as long as the ashtray is allowed to move vertically in relation to the mounting bracket and the ashtray does not pull away from the bracket. For example, the ashtray can have the same functionality if locking nut 50 was flat and did not have an extension 58 as long as the first elongated slot was resized accordingly.

Mounting bracket 30 may be attached to the wall 31 of a building using any known method such as adhesives, welding, nails, or bolts. Preferably, mounting bracket 30 contains a plurality of bores 42 through which a screw is inserted and rigidly fixed to the building sufficiently to prevent theft of the ashtray.

In use, projection 16 (attached to ashtray 10) is inserted through first elongated vertical slot 38 through the front surface of mounting bracket 30. Locking nut 50 is then inserted with its extension 58 first into the second elongated vertical slot 40 and pressed over projection 16 to snap-fasten nut 50 to projection 16 thereby locking ashtray 10 in place to complete the bracket tube assembly. This assembly is then attached to wall 31 using any of the methods described above. To set up the ashtray assembly, ashtray 10 is moved vertically upward and rotated such that open end 12 is on top and then vertically lowered until alignment fin 20 is in alignment slot 37. The ashtray assembly now is prevented from rotating and is relatively fixed in place.

Smokers place their ashes, cigarette butts, on other trash into ashtray 10. To empty the ashtray, a cleaner or janitor lifts ashtray 10 vertically freeing fin 20 of ashtray 10 from alignment slot 37 in the mounting bracket. The cleaner then rotates ashtray 10 180 degrees to dump out its contents into a receptacle. If trash remains in ashtray 10, the cleaner inserts a rod in the opening of the closed end to remove remaining trash. The cleaner then lifts ashtray 10 vertically and rotates it 180 degrees to realign alignment fin 20 and alignment slot 37. Once aligned, the cleaner than vertically lowers ashtray 10 until alignment fin 20 rests in alignment slot 37 thereby latching the ashtray with respect to the mounting bracket and preventing further downward movement and further rotation.

If ashtray assembly 1 comprises locking nub 22 and locking notch 41, ashtray 10 must first be rotated such that locking nub 22 is not in locking notch 41 before ashtray 10 can be lifted. Subsequently, ashtray 10 should be rotated such that locking nub 22 is within locking notch 41 after the ashtray is emptied.

As many possible embodiments may be made of the invention without departing from the scope thereof, it is to be understood than all matter herein set forth or shown in the accompanying drawings is to be interpreted as illustrative and not in a limiting sense.

What is claimed is:

1. A mountable ashtray assembly comprising:

a tube-like ashtray having an open end and a closed end for storing cigarette butts, the ashtray having a projection;

a locking nut sized to receive the ashtray projection;

a mounting bracket adapted for mounting the ashtray assembly to a structure, the mounting bracket having top surfaces, a front surface, and a rear surface, the front surface having a first elongated vertical slot through the mounting bracket sized to receive the ashtray projection, the rear surface having a second elongated vertical slot sized to receive the locking nut, the second elongated vertical slot coaxial with the first elongated vertical slot, the mounting bracket having means for attaching the mounting bracket to the structure; and wherein the ashtray projection is inserted through the elongated slot on the front surface of the mounting bracket and the locking nut is placed over the ashtray projection from the rear surface of the mounting bracket and into the second elongated slot and then the assembly is adapted for mounting to the structure such that the ashtray can rotate about the projection and slide vertically along the elongated slots.

2. The assembly of claim 1 wherein the ashtray further comprises an alignment fin and the mounting bracket comprises an alignment slot on its top surface; and wherein the alignment fin fits into the alignment slot to prevent rotational movement of the ashtray assembly until the ashtray is moved vertically upward sufficiently that the alignment fin is no longer positioned in the slot.

3. A mountable ashtray assembly for a structure comprising:

a tube-like ashtray having an open end and a closed end for storing cigarette butts, the ashtray having a projection;

a locking nut sized to receive the ashtray projection;

a mounting bracket for mounting the ashtray assembly to the structure, the mounting bracket having a front surface and a rear surface, the front surface having a vertical first elongated slot through the mounting bracket sized to receive the ashtray projection, the rear surface having a vertical second elongated slot sized to receive the locking nut and coaxial with the first elongated slot, the mounting bracket having bores therein for receiving screws to mount the mounting bracket to the structure; and wherein before the mounting bracket is mounted to the structure the ashtray projection is inserted through the elongated slot on the front surface of the mounting bracket and the locking nut is placed over the ashtray projection from the rear surface of the mounting bracket and into the second elongated slot and than the assembly is mounted to the structure such that the ashtray can rotate about the projection and slide vertically along the elongated slots with respect to the structure.

4. The assembly of claim 3 wherein the ashtray further comprises an aligning fin and the mounting bracket comprises an alignment slot; and wherein the alignment fin fits into the alignment slot to prevent rotational movement of the ashtray assembly until the ashtray is moved vertically upward such that the alignment fin is no longer positioned in the slot.

5. The assembly of claim 1 wherein the closed end of the ashtray has a bore therein.

6. The assembly of claim 3 wherein the closed end of the ashtray has a bore therein.

7. The assembly of claim 4 wherein the alignment fin further comprises a locking nub and the mounting bracket further comprises a notch; and wherein the locking nub is movable from a position within the notch to prevent upward movement of the ashtray to outside the notch to allow the ashtray to be vertically lifted.

* * * * *